US012059117B2

(12) United States Patent
Muir et al.

(10) Patent No.: US 12,059,117 B2
(45) Date of Patent: Aug. 13, 2024

(54) VACUUM CLEANER AND CLEANING ACCESSORY FOR A VACUUM CLEANER

(71) Applicant: Black & Decker, Inc., New Britain, CT (US)

(72) Inventors: Derek Muir, Durham (GB); Oleksiy Sergyeyenko, Baldwin, MD (US); Lance Zhang, Towson, MD (US)

(73) Assignee: Black & Decker, Inc., New Britain, CT (US)

( * ) Notice: Subject to any disclaimer, the term of this patent is extended or adjusted under 35 U.S.C. 154(b) by 22 days.

(21) Appl. No.: 17/591,794

(22) Filed: Feb. 3, 2022

(65) Prior Publication Data

US 2023/0284848 A1 Sep. 14, 2023

(51) Int. Cl.
*A47L 9/04* (2006.01)
*A47L 5/30* (2006.01)

(52) U.S. Cl.
CPC ..... *A47L 9/0488* (2013.01); *A47L 5/30* (2013.01); *A47L 9/0411* (2013.01); *A47L 9/0477* (2013.01)

(58) Field of Classification Search
CPC .... A47L 9/0488; A47L 9/0411; A47L 9/0466; A47L 9/0477; A47L 9/0673; A47L 9/068; A47L 9/0633; A47L 9/066; A47L 9/0666; A47L 11/40; A47L 11/4094; A47L 11/00; A47L 11/14; A47L 11/20; A47L 5/30
USPC ..... 15/383
See application file for complete search history.

(56) References Cited

U.S. PATENT DOCUMENTS 4,355,436 A * 10/1982 Hertzberg ..... A47L 5/30 15/368
8,239,992 B2 8/2012 Schnittman et al.
8,661,594 B2 * 3/2014 Hui ..... E04H 4/1654 15/1.7
2006/0272122 A1 12/2006 Butler et al.
2008/0307597 A1 12/2008 Davidshofer et al.
2010/0107357 A1 * 5/2010 Odachi ..... A47L 9/0411 15/389
2013/0192024 A1 * 8/2013 Eriksson ..... A47L 11/4041 15/389

FOREIGN PATENT DOCUMENTS

DE 102015101587 B3 7/2015
EP 2561785 B1 10/2015
(Continued)

OTHER PUBLICATIONS

Extended EP Search Report, dated Jun. 30, 2023, for corresponding EP Application No. 23154424.8-1016.

*Primary Examiner* — Abbie E Quann
(74) *Attorney, Agent, or Firm* — John Yun

(57) ABSTRACT

A cleaning accessory for a vacuum cleaner comprises a housing. At least one rotatable cleaning brush is rotatably mounted to the housing and configured to engage a surface to be cleaned. The at least one rotatable cleaning brush comprises at least one flexible cleaning element projecting outwards from a side of the housing. The at least one flexible cleaning element is arranged to rotate in a cleaning position and rotate in a disengaged position whereby the at last one flexible cleaning element engages the surface to be cleaned when rotating in the cleaning position and the at last one flexible cleaning element is remote from the surface to be cleaned when rotating in the disengaged position.

17 Claims, 9 Drawing Sheets

(56) References Cited

FOREIGN PATENT DOCUMENTS

| | | | | |
|---|---|---|---|---|
| EP | 2849620 | B1 | 7/2016 | |
| GB | 2486977 | B | 9/2014 | |
| WO | 2003007776 | A1 | 1/2003 | |
| WO | 2019035050 | A1 | 2/2019 | |
| WO | WO-2019035050 | A1 * | 2/2019 | ..... A47L 9/0411 |

* cited by examiner

FIRST MODE OF OPERATION

SECOND MODE OF OPERATION

VACUUM CLEANER AND CLEANING ACCESSORY FOR A VACUUM CLEANER

BACKGROUND OF THE INVENTION

The present disclosure relates to a vacuum cleaner and cleaning accessory for a vacuum cleaner. In particular the present disclosure relates to a cleaning accessory with improved edge cleaning.

Vacuum cleaners such as stickvacs, upright vacuum cleaners or floor vacuum cleaners with a hose attachment typically comprise cleaning accessories for cleaning floors and the like. Some of these cleaning accessories comprise a floor cleaning head and the floor cleaning head may comprise rotating brushes to improve dirt pick up.

When a user cleans a floor surface near an upright surface such as a wall, the user may find that the width of the floor cleaning head prevents dirt pick up at the edge of the floor surface and the wall. This means that the user has to repeat the cleaning process with another accessory such as a crevice tool to ensure the edge of the floor surface is properly cleaned.

Some known cleaning devices such as robotic vacuum cleaners e.g. as shown in U.S. Pat. No. 8,239,992 have additional brushes for cleaning surfaces at the side of the cleaning device. A problem with this arrangement is that brushes do not adequately engage the edge of the floor surface and the wall and the robotic vacuum cleaner does not have a powerful motor fan assembly. This means that dirt pick up along the sides of the robotic vacuum cleaner may not be sufficient to pick up dirt with a single pass.

BRIEF SUMMARY OF THE INVENTION

Examples of the present disclosure aim to address the aforementioned problems.

According to a first aspect of the present disclosure there is a cleaning accessory for a vacuum cleaner comprising: a housing; at least one rotatable cleaning brush rotatably mounted to the housing and configured to engage a surface to be cleaned; wherein the at least one rotatable cleaning brush comprises at least one flexible cleaning element projecting outwards from a side of the housing; and the at least one flexible cleaning element is arranged to rotate in a cleaning position and rotate in a disengaged position whereby the at last one flexible cleaning element engages the surface to be cleaned when rotating in the cleaning position and the at last one flexible cleaning element is remote from the surface to be cleaned when rotating in the disengaged position.

Optionally, the at least one flexible cleaning element is biased to the disengaged position.

Optionally, the at least one flexible cleaning element is arranged to flex from the disengaged position to the cleaning position when a force is applied to the at least one flexible cleaning element in a direction parallel to the rotation axis of the rotatable cleaning brush.

Optionally, the at least one flexible cleaning element is arranged to flex from the disengaged position to the cleaning position when the side of the housing is adjacent to an upright surface.

Optionally, the cleaning accessory comprises a rotatable cleaning bar rotatably mounted within the housing and the at least one rotatable cleaning brush is rotatably coupled to the rotatable cleaning bar.

Optionally, the rotatable cleaning bar comprises a first end arranged at the side of the housing and a first rotatable cleaning brush is mounted to the first end.

Optionally, the at least one rotatable cleaning brush comprises a rotatable body and at least part of the rotatable body is arranged to project through the side of the housing to mount to the first end of the rotatable cleaning bar.

Optionally, the at least one rotatable cleaning brush is removably mountable on the rotatable cleaning bar.

Optionally, a drive mechanism is rotatably coupled between the at least one rotatable cleaning brush and the rotatable cleaning bar.

Optionally, the drive mechanism comprises a drive gear fixable to the at least one rotatable cleaning brush and the rotatable cleaning bar.

Optionally, the drive mechanism is configured to rotate the at least one rotatable cleaning brush and the rotatable cleaning bar at the same rate of rotation.

Optionally, the drive mechanism comprises a motor.

Optionally, the motor is mounted within the rotatable cleaning bar.

Optionally, the motor is mounted to the housing adjacent to the rotatable cleaning bar.

Optionally, the at least one rotatable cleaning brush and the rotatable cleaning bar are arranged to rotate about a common rotation axis.

Optionally, the at least one flexible element when rotating in the cleaning position and the rotatable cleaning bar extend radially from the common rotation axis the same distance.

Optionally, the at least one flexible element does not project below a lower wall of the housing adjacent to the surface to be cleaned when rotating in the disengaged position.

Optionally, the wherein the rotatable cleaning bar comprises a second end and a second rotatable cleaning brush is mounted to the second end.

In a second aspect of the disclosure there is a vacuum cleaner device comprising a cleaning accessory according to the first aspect.

In a third aspect of the disclosure there is provided, a cleaning accessory for a vacuum cleaner comprising: a housing having a first air inlet on an underside of the housing and an air outlet and a first airflow path between the first air inlet and the air outlet; at least one cleaning brush having at least one flexible cleaning element projecting outwards from a side of the housing; and at least one side air inlet on the side of the housing and a second airflow path between the at least one side inlet and the air outlet; wherein the at least one flexible cleaning element is arranged to engage a surface to be cleaned adjacent to the at least one side air inlet.

Optionally, the at least one cleaning brush is a first cleaning brush mounted on a first side of the housing and a second cleaning brush is mounted on a second side of the housing.

Optionally, the at least one side air inlet is a first side air inlet one the first side of the housing and a second side air inlet on the second side of the housing.

Optionally, the at least one side air inlet comprises a projecting lip arranged to guide dirt into the at least one side air inlet.

Optionally, the at least one cleaning brush is moveably mounted on the housing.

Optionally, the at least one flexible cleaning element is moveable from a first position remote from the at least one side air inlet to a second position adjacent to the at least one side air inlet.

Optionally, the at last one cleaning brush is rotatably mounted on the side of the housing and the at least one cleaning brush is arranged to sweep the surface to be cleaned in a direction towards the at least one side air inlet.

Optionally, the at least one flexible cleaning element is arranged to flex from a disengaged position to the cleaning position when a force is applied to the at least one flexible cleaning element in a direction parallel to the rotation axis of the at least one flexible cleaning element.

Optionally, the at least one flexible cleaning element is arranged to flex from the disengaged position to the cleaning position when the side of the housing is adjacent to an upright surface.

Optionally, the side of the housing comprises a brush recess.

Optionally, the brush recess is arranged to receive the at least one flexible cleaning element when the side of the housing is adjacent to an upright surface and the at least one flexible cleaning element flexes into the cleaning position.

Optionally, at least part of the first airflow path and the second airflow path overlap.

Optionally, the cleaning accessory comprises a rotatable cleaning bar rotatably mounted within the housing and the cleaning brush is rotatably coupled to the rotatable cleaning bar.

Optionally, the cleaning brush and the rotatable cleaning bar rotate at the same rate of rotation.

Optionally, the cleaning brush is removably mounted on the rotatable cleaning bar.

Optionally, at least part of the first airflow path and the second airflow path are located around the rotatable cleaning bar.

Optionally, the first air inlet is formed in a front wall of the housing.

In a fourth aspect of the disclosure, there is a vacuum cleaner device comprising a cleaning accessory according to the third aspect.

In a fifth aspect of the disclosure there is provided a cleaning accessory for a vacuum cleaner comprising: a housing; a rotatable cleaning brush rotatably mounted to the housing having at least one flexible cleaning element projecting outwards from a side of the housing and the at least one flexible cleaning element is configured to rotate and engage with a surface to be cleaned; and a dirt deflector projecting from the side of the housing and configured to surround at least part of the perimeter of the rotatable cleaning brush.

Optionally, the dirt deflector extends along the perimeter of the rotatable cleaning brush on the housing above the rotatable cleaning brush.

Optionally, the dirt deflector extends along the perimeter of the rotatable cleaning brush on the housing behind the rotatable cleaning brush.

Optionally, the dirt deflector extends along the perimeter of the rotatable cleaning brush between 25% to 50% of the length of the perimeter of the rotatable cleaning brush.

Optionally, the housing has at least one side air inlet on the side of the housing wherein the at least one flexible cleaning element is arranged to sweep dirt towards the at least one second air inlet.

Optionally, the dirt deflector is configured to surround at least part of the at least one side air inlet.

Optionally, the dirt deflector comprises a projecting finger configured to engage the at least one flexible element when the at least one flexible element is rotating.

Optionally, the at least one projecting finger is configured to engage the at least one flexible element after the at least one flexible element has moved past the at least one side air inlet.

Optionally, the at least one flexible cleaning element is arranged to flex from a disengaged position to the cleaning position when a force is applied to the at least one flexible cleaning element in a direction parallel to the rotation axis of the at least one flexible cleaning element.

Optionally, the at least one flexible cleaning element is arranged to flex from the disengaged position to the cleaning position when the side of the housing is adjacent to an upright surface.

Optionally, the dirt deflector is engageable with an upright surface.

Optionally, the dirt deflector extends a distance from the side wall of the housing greater than a distance the at least one flexible cleaning element projects from the side wall of the housing when the at least one flexible cleaning element flexes into the cleaning position.

Optionally, the dirt deflector extends to an edge of the side of the housing which is configured to engage the surface to be cleaned In a sixth aspect of the disclosure there is provided a vacuum cleaner device comprising a cleaning accessory according to the fifth aspect.

In a seventh aspect of the disclosure there is provided a cleaning accessory for a vacuum cleaner comprising: a housing; a rotatable cleaning brush rotatably mounted to the housing having at least one flexible cleaning element projecting outwards from a side of the housing and the at least one flexible cleaning element is configured to rotate and engage with a surface to be cleaned; and a rotatable cleaning bar rotatably mounted within the housing and the rotatable cleaning brush is rotatably coupled to the rotatable cleaning bar; wherein at least a portion of the rotatable cleaning brush is seated within the rotatable cleaning bar or a drive mechanism coupled to the rotatable cleaning bar.

Optionally, the rotatable cleaning bar comprises a first end arranged at the side of the housing and the rotatable cleaning brush is mounted to the first end.

Optionally, the rotatable cleaning brush comprises a rotatable body and at least part of the rotatable body is arranged to project through the side of the housing to mount to the first end of the rotatable cleaning bar.

Optionally, the rotatable body comprises a conical engagement surface and the rotatable cleaning bar or the drive mechanism comprises a reciprocal engagement recess and the conical engagement surface is configured to be seated within the reciprocal engagement recess when the rotatable cleaning brush is rotatably coupled to the rotatable cleaning bar.

Optionally, the rotatable cleaning brush is removably mountable on the rotatable cleaning bar.

Optionally, the drive mechanism is rotatably coupled between the rotatable cleaning brush and the rotatable cleaning bar.

Optionally, the drive mechanism comprises a drive gear fixable to the rotatable cleaning brush and the rotatable cleaning bar.

Optionally, the drive mechanism is configured to rotate the rotatable cleaning brush and the rotatable cleaning bar at the same rate of rotation.

Optionally, the drive mechanism comprises a motor.

Optionally, the motor is mounted within the rotatable cleaning bar.

Optionally, the motor is mounted to the housing adjacent to the rotatable cleaning bar.

Optionally, the rotatable cleaning brush and the rotatable cleaning bar are arranged to rotate about a common rotation axis.

Optionally, the cleaning accessory comprises a first rotatable cleaning brush is seated within the rotatable cleaning bar and a second rotatable cleaning brush is seated within the drive mechanism coupled to the rotatable cleaning bar.

In an eighth aspect of the disclosure, there is provided a vacuum cleaner device comprises a cleaning accessory according to the seventh aspect.

BRIEF DESCRIPTION OF THE DRAWINGS

Various other aspects and further examples are also described in the following detailed description and in the attached claims with reference to the accompanying drawings, in which:

DETAILED DESCRIPTION OF THE PREFERRED EMBODIMENTS

Figure 1:
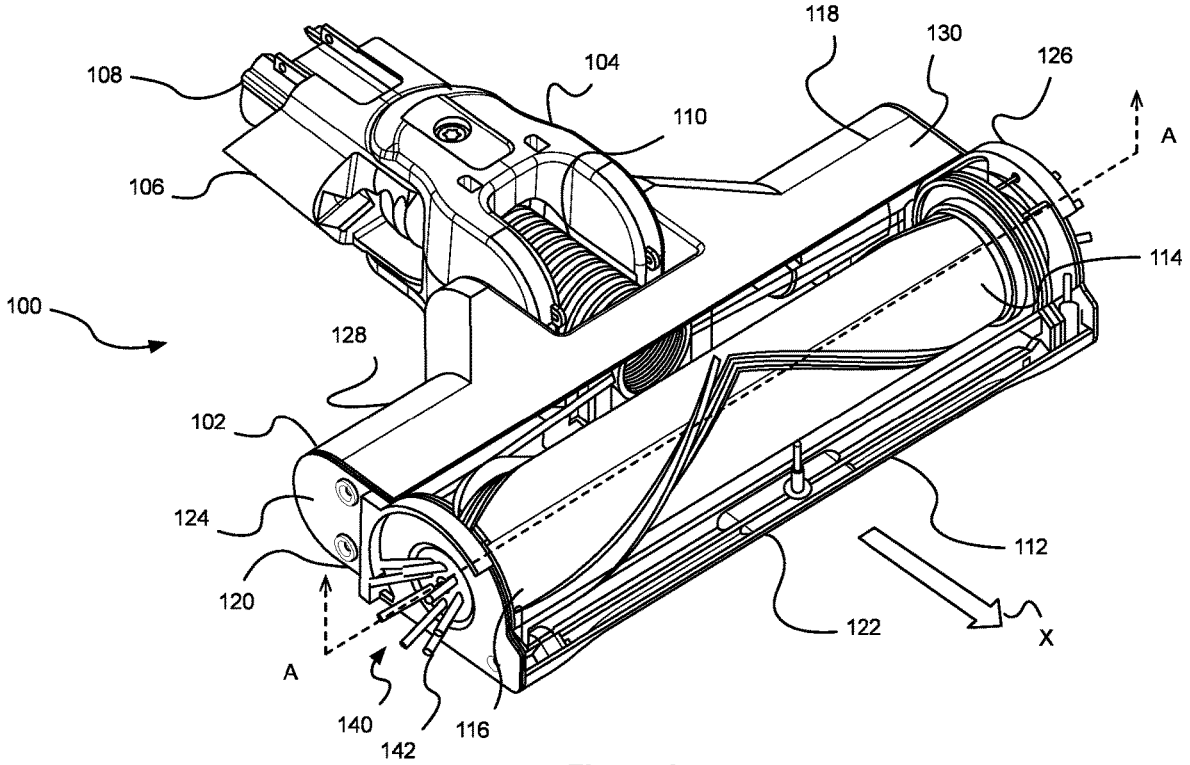
FIG. 1 shows a perspective view of a cleaning accessory for a vacuum cleaner according to an example.

FIG. 1 shows a perspective view of a cleaning accessory 100 for a vacuum cleaner (not shown). The cleaning accessory 100 is optionally a floor cleaning head arranged to engage and clean a floor surface 400 to be cleaned. The cleaning accessory 100 comprises a housing 102 on which an optional articulated joint 104 is mounted. The articulated joint 104 couples the housing 102 to a neck portion 106. The housing 102 is arranged to move over a surface 400 to be cleaned such as a floor. In some examples, a lower surface 120 of the housing 102 optionally comprises one or more wheels (not shown) for engaging the surface 400 to be cleaned.

The housing 102 comprises a first side wall 124 and a second side wall 126, a front wall 122 and a back wall 128. The housing 102 further comprises a top wall 130 and a lower wall 120. In this way the housing 102 defines an enclosure for mounting one or more components of the cleaning accessory 100. The front wall 122 faces the direction of travel when a user pushes the cleaning accessory 100 on a surface 400 to be cleaned away from themselves. The forwards direction of travel of the cleaning accessory 100 is illustrated in FIG. 1 by the arrow labelled X. Likewise, the back wall 128 faces the direction of travel when a user pulls the cleaning accessory on a surface 400 to be cleaned away towards themselves.

The neck portion 106 comprises an attachment mechanism 108 for attaching to a hose (not shown), extension tube (not shown), or the housing (not shown) of the vacuum cleaner. The attachment mechanism 108 is known and will not be described in any further detail.

Figure 9:
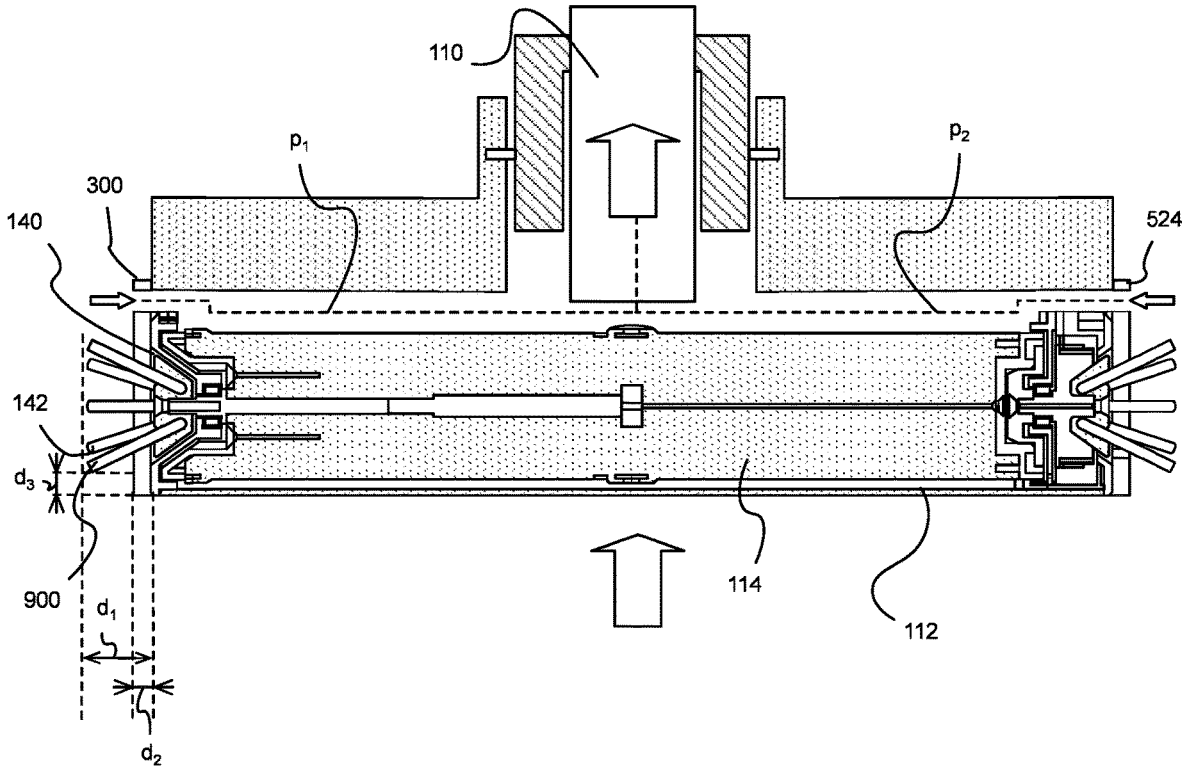
FIG. 9 shows a cross-sectional underneath plan view along A-A of a cleaning accessory for a vacuum cleaner according to an example.

The cleaning accessory 100 is connectable to a handheld vacuum cleaner via an extension tube, a canister vacuum cleaner via a hose or directly to an upright or a stickvac vacuum cleaner. The neck portion 106 comprises an air outlet 110 which is in fluid communication with a first air inlet 112 in the housing 102. The air outlet 110 is in fluid communication with a motor-fan assembly (not shown) in the vacuum cleaner. In this way, a first airflow path is provided between the first air inlet 112 and the air outlet 110. Accordingly dirty air flows in from the first air inlet 112 to the air outlet 110. In some examples, the first air inlet 112 extends across the width of the housing 102. As shown in FIG. 9, the first air inlet 112 is positioned on an underside of the housing 102 e.g. on the lower surface 120 of the housing 102. FIG. 9 shows a cross-sectional underneath plan view along A-A of the cleaning accessory 100. This means that the first air inlet 112 is adjacent to the surface 400 to be cleaned during operation. In some examples the first air inlet 112 extends to the front wall 122 of the housing 102.

The neck portion 106 may optionally comprise electrical power and control wires for powering and controlling functionality in the cleaning accessory 100. The vacuum cleaner can optionally comprise one or more control buttons (not shown) for actuating a motor 500 (best shown in FIG. 5) to drive a rotatable cleaning bar 114. The rotatable cleaning bar 114 may also be known as a brush bar and will be described in more detail below.

In some examples, the motor 500 is mounted in a motor housing portion 118 of the housing 102. The motor 500 will be described in more detail below in reference to FIG. 5. In some other examples which are not shown in the Figures, the motor 500 is mounted within the rotatable cleaning bar 114.

The articulated joint 104 provides at least two degrees of freedom of the housing 102 with respect to the neck portion 106. The articulated joint 104 as shown in FIG. 1 comprises two pivot axes which are mounted perpendicular to each other. The articulated joint 104 is known and will not be discussed in any further detail.

The cleaning accessory 100 optionally comprises rotatable cleaning bar 114 which is rotatably mounted in the cleaning accessory 100. Whilst the Figures show a rotatable cleaning bar 114, in some alternative examples, there is no rotatable cleaning bar 114. In this case, the dirt pick up into the first air inlet 112 is only due to the airflow. Hereinafter, all the examples will be discussed in reference to the Figures which show a rotatable cleaning bar 114 rotatably mounted to the housing 102.

In some embodiments, the rotatable cleaning bar 114 is optionally removably mountable in the housing 102. Removal of the rotatable cleaning bar 114 is known and will not be discussed in further detail. The rotatable cleaning bar 114 is optionally mounted beneath a transparent cover 116 which is partially shown in FIG. 1 for the purposes of clarity. This means that the user can see when the rotatable cleaning bar 114 is in operation and when the rotatable cleaning bar 114 requires maintenance.

Figure 2:
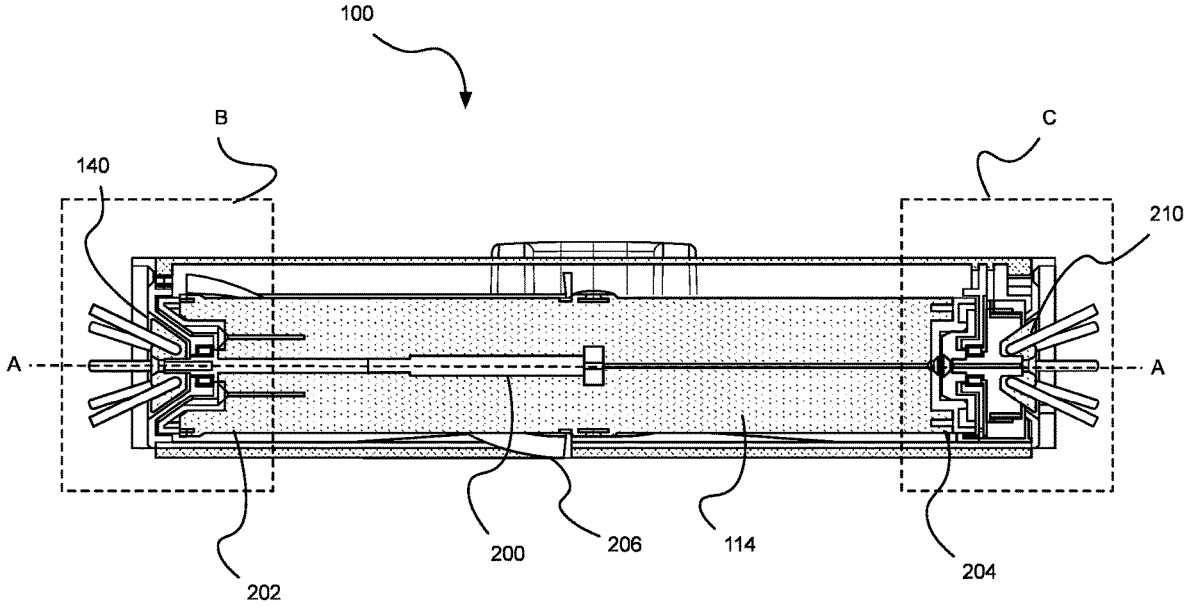
FIG. 2 shows a cross-sectional side view along A-A of a cleaning accessory for a vacuum cleaner according to an example.

Turning to FIG. 2, the rotatable cleaning bar 114 will be described in further detail. FIG. 2 shows a cross-sectional side view along A-A (as shown in FIG. 1) of the cleaning accessory 100. The rotatable cleaning bar 114 is mounted on a shaft 200 and the shaft 200 is rotatably mounted to the housing 102. The rotatable cleaning bar 114 is mounted to the housing 102 such that at least a portion of the rotatable cleaning bar 114 extends through the first air inlet 112. The rotatable cleaning bar 114 is arranged to rotate about rotation axis A-A. The rotation axis A-A is substantially parallel to a horizontal surface 400 e.g. a floor to be cleaned.

In some embodiments, the shaft 200 is optionally a drive shaft (not shown) which is coupled to the motor 500 for rotating the rotatable cleaning bar 114. The drive shaft of the motor 500 is parallel with the rotation axis A-A of the rotatable cleaning bar 114. Alternatively, the motor 500 is mounted inside the of rotatable cleaning bar 114. In this case, the drive shaft of the motor 500 is coaxial with the rotation axis A-A of the rotatable cleaning bar 114.

The rotatable cleaning bar 114 is generally linear in construction and extends along a longitudinal axis A-A. The shaft 200 can extend along the rotatable cleaning bar 114 along the axis A-A as shown in FIG. 2. Alternatively, the shaft 200 can be formed from two separate sections at a first end 202 and a second end 204 of the rotatable cleaning bar 114.

In some embodiments the rotatable cleaning bar 114 is a substantially cylindrical element. In other embodiments the rotatable cleaning bar 114 is elongate and substantially cylindrical and comprises ridges and groves. For example, the rotatable cleaning bar 114 can comprise spiral grooves and/or ridges for receiving one or more flexible cleaning elements such as cleaning brushes or ribs.

In some examples, the rotatable cleaning bar 114 as shown in FIG. 2 comprises at least one flexible cleaning bar element 206. The at least one flexible cleaning bar element 206 as shown in FIG. 2 is a part of a flexible rubber rib mounted in a spiral on the rotatable cleaning bar 114. The flexible cleaning bar element 206 is configured to flex when it engages the surface 400 to be cleaned and pick up dirt and debris. In other examples the flexible cleaning bar element 206 can be a cleaning brush having a plurality of projecting bristle cleaning elements. Additionally, or alternatively the rotatable cleaning bar 114 comprises different types of cleaning elements, such as bristles, brushes, silicone ribs, silicone fingers, rubber fins, etc. In some embodiments, the flexible cleaning elements can be any means suitable for cleaning a surface 400.

Further discussion of the cleaning accessory 100 will be made in reference to FIGS. 4*a* and 4*b*. When a user cleans a floor surface 400 near an upright surface 402 such as a wall, the user may find that the width of a cleaning accessory 100 prevents dirt pick up at the edge 404 of the floor surface 400 and the upright surface 402. This means that the user has to repeat the cleaning process with another accessory such as a crevice tool or repeatedly pass the cleaning accessory 100 over the edge 404 to ensure the edge 404 of the floor surface 400 is properly cleaned. In order to improve the edge cleaning of the floor, the cleaning accessory 100 comprises at least one rotatable cleaning brush 140.

As shown in FIG. 1, a first rotatable cleaning brush 140 comprises a rotatable body 604 (best shown in FIG. 6) and at least one flexible cleaning element 142 is mounted to the rotatable body 604. The at least one flexible cleaning element 142 projects outwards from the first side wall 124 of the housing 102. In some examples the first rotatable cleaning brush 140 comprises a plurality of flexible cleaning elements 142. The flexible cleaning elements 142 are deformable and configured to engage the surface 400 to be cleaned when in a deformed position.

In some examples, the flexible cleaning elements 142 are a plurality of discrete groups of bristles as shown in FIGS. 1 and 2. In some other examples, the first rotatable cleaning brush 140 comprise additionally or alternatively bristles, brushes, silicone ribs, silicone fingers, rubber fins, etc. The flexible cleaning elements 142 can optionally be continuous (not shown in the Figures) over the entire first rotatable cleaning brush 140.

In some examples, the flexible cleaning elements 142 are deformable between a first mode of operation and a second mode of operation.

Figure 3A:
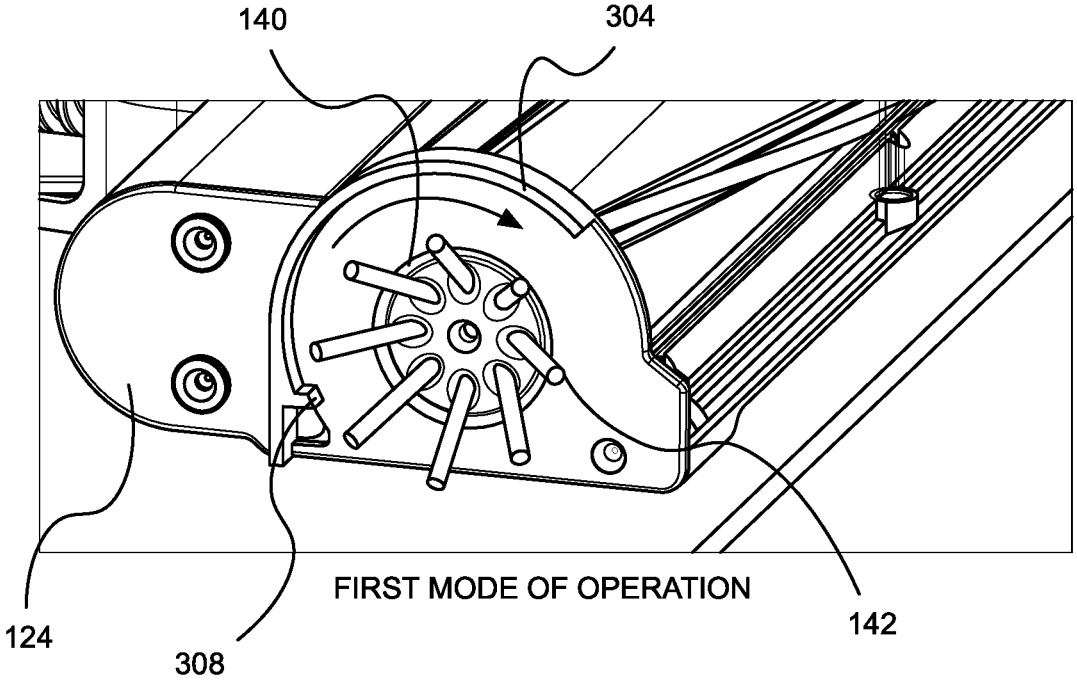
FIGS. 3*a* and 3*b* show a perspective view of a cleaning accessory for a vacuum cleaner respectively in different modes of operation according to an example.

In the first mode of operation the at least one flexible cleaning element 142 is arranged to rotate in a disengaged position. In the disengaged position, the flexible cleaning elements 142 are arranged to be remote from the surface 400 to be cleaned when rotating in the disengaged position. The first rotatable cleaning brush 140 is shown with the flexible cleaning elements 142 in the disengaged position in FIGS. 3*a* and 4*a*. FIG. 4*a* shows a cross-sectional side view along A-A of the cleaning accessory 100 in the first mode of operation. FIG. 3*a* also shows a perspective view of the cleaning accessory 100 in the first mode of operation.

This means that when the first rotatable cleaning brush 140 rotates with the flexible cleaning elements 142 in the disengaged position, the first rotatable cleaning brush 140 does not engage the surface 400 to be cleaned. This means first rotatable cleaning brush 140 does not pick up dirt and spread it around. This is convenient when the cleaning accessory 100 is being used on the surface 400 to be cleaned not near an upright surface 402.

Figure 3B:
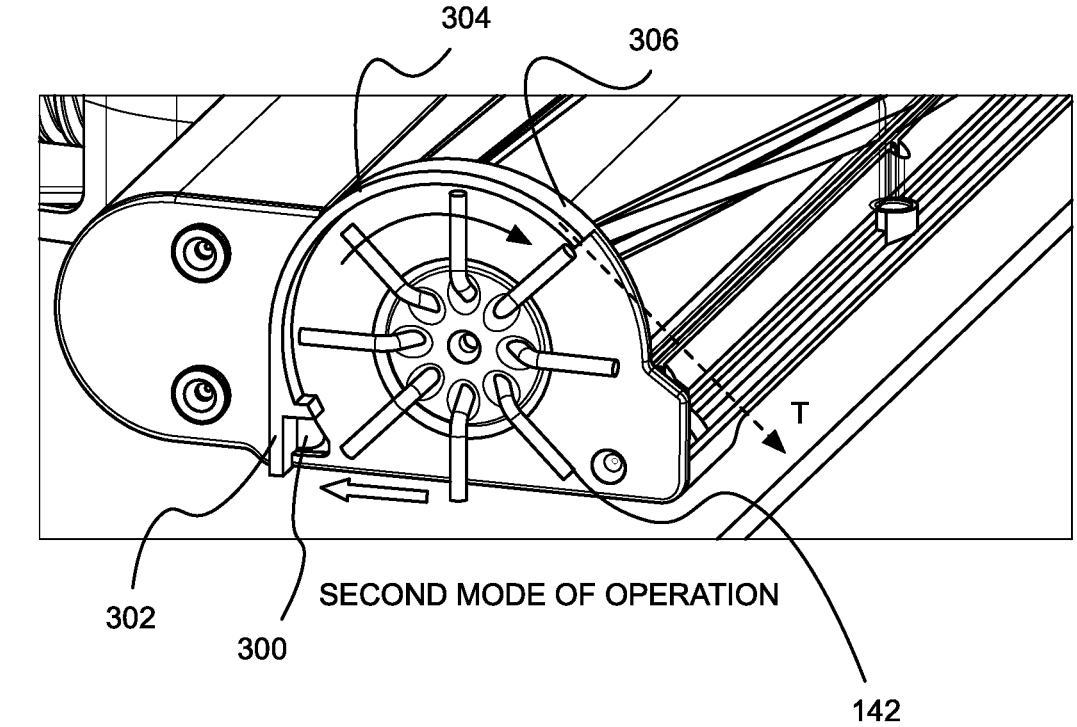

In the second mode of operation, the at least one flexible cleaning element 142 is arranged to rotate in a cleaning position. In the cleaning position, the flexible cleaning elements 142 are arranged to engage the surface 400 to be cleaned when rotating in the cleaning position. The first rotatable cleaning brush 140 is shown with the flexible cleaning elements 142 in the cleaning position in FIGS. 3*b* and 4*b*. FIG. 4*b* shows a cross-sectional side view along A-A of the cleaning accessory 100 in the first mode of operation. FIG. 3*b* also shows a perspective view of the cleaning accessory 100 in the second mode of operation.

This means that when the first rotatable cleaning brush 140 rotates with the flexible cleaning elements 142 in the engaged position, the first rotatable cleaning brush 140 engages the surface 400 to be cleaned. This means first rotatable cleaning brush 140 picks up dirt as discussed further below.

Accordingly, the cleaning accessory 100 comprises rotating cleaning brushes 140 which are mounted on the outside of the first side wall 124 of the housing 102. This means that edge cleaning of the surface 400 to be cleaned near an upright surface 402 e.g. a wall, kickboard, skirting board, or other upright surface 402 intersecting with the surface 400 to be cleaned can be achieved when moving the cleaning accessory 100 in a direction parallel to the upright surface 402.

This means that up to the edge cleaning can be achieved at the same time as cleaning other parts of the floor surface 400. Previously, a user may have had to perform a series of movements with the cleaning accessory 100 in a direction perpendicular to the upright surface 402 so that the front of the cleaning accessory 100 is adjacent to the edge 404. However, in contrast the edge 404 can be cleaned in a single pass of the cleaning accessory 100 in a movement parallel to the upright surface 402 and edge 404.

The flexible cleaning elements 142 are resiliently deformable. In some examples the flexible cleaning elements 142 are biased into the disengaged position as shown in FIGS. 3*a* and 4*a*. This means that when the flexible cleaning elements 142 are deformed in to the cleaning position and then released, the flexible cleaning elements 142 will return to the disengaged position as shown in Figured 4*a*. In other words, when the cleaning accessory 100 is moved away from a position engaging the upright surface 402 as shown in FIG. 4*b*, to a position remote from the upright surface 402 as shown in FIG. 4*a*, the flexible cleaning elements 142 return to the disengaged position.

In the first mode of operation, the flexible cleaning elements 142 extend outwards from the first side wall 124 by a first distance $d_1$ as shown in FIG. 9. In the second mode of operation, the flexible cleaning elements 142 extend outwards from the first side wall by a second distance $d_2$. In the second mode of operation, the flexible cleaning elements 142 rotate in the disengaged position whereby an end 900 of the flexible cleaning element 142 is maintained at a distance $d_3$ above the surface 400 to be cleaned.

The flexible cleaning elements 142 are arranged to flex from the disengaged position to the cleaning position when a force is applied to the at least one flexible cleaning element 142. In some examples, the force to deform the flexible cleaning elements 142 is in a direction parallel to the rotation axis A-A of the rotatable cleaning brush 140. For example, when the cleaning accessory 100 is moved adjacent (represented by the arrow in FIG. 4*b*) to an upright surface 402 such as a wall, the flexible cleaning elements 142 are arranged to deform.

As mentioned above, in some examples the flexible cleaning elements 142 extend from the rotation axis A-A to engage the surface 400 to be cleaned in the second mode of operation. When the flexible cleaning elements 142 are in the second mode of operation, the flexible cleaning elements 142 and the rotatable cleaning bar 114 extend in a radial direction from the rotation axis A-A towards the surface 400 by the same distance. This means that when the cleaning accessory 100 is moved across the surface 400 to be cleaned, the cleaning accessory 100 remains substantially level.

In some examples, the first rotatable cleaning brush 140 is rotatably coupled to the first end 202 of the rotatable cleaning bar 114. In some further examples additionally or alternatively a second rotatable cleaning brush 210 (as shown in FIG. 2) is rotatably coupled to the second end 204 of the rotatable cleaning bar 114. The second rotatable cleaning brush 210 is identical to the first rotatable cleaning brush 140 as previously described.

In some examples optionally the cleaning accessory 100 has a single rotatable cleaning brush 140 mounted to only one of the first or second end 202, 204 of the rotatable cleaning bar 114. In some other examples as shown in FIG. 2, there are a first and second rotatable cleaning brushes 140, 210 mounted to the rotatable cleaning bar 114. By having first and second rotatable cleaning brushes 140, 210, edges 404 positioned to either the first side wall 124 or the second side wall 126 can be cleaned with the cleaning accessory 100. In some other examples there are optionally more than two rotatable cleaning brushes and there can be any suitable number of rotatable cleaning brushes projecting out of the sides of the cleaning accessory 100.

In some examples, the first rotatable cleaning brush 140 is rotatably coupled to the rotatable cleaning bar 114 and is fixed to the rotatable cleaning bar 114. In this way, when the rotatable cleaning bar 114 rotates, the first rotatable cleaning brush 140 and the rotatable cleaning bar 114 rotate together. Similarly, in some examples, the second rotatable cleaning brush 210 is rotatably coupled to the rotatable cleaning bar 114 and is fixed to the rotatable cleaning bar 114. In this way, when the rotatable cleaning bar 114 rotates, the second rotatable cleaning brush 210 and the rotatable cleaning bar 114 rotate together.

Figure 5:
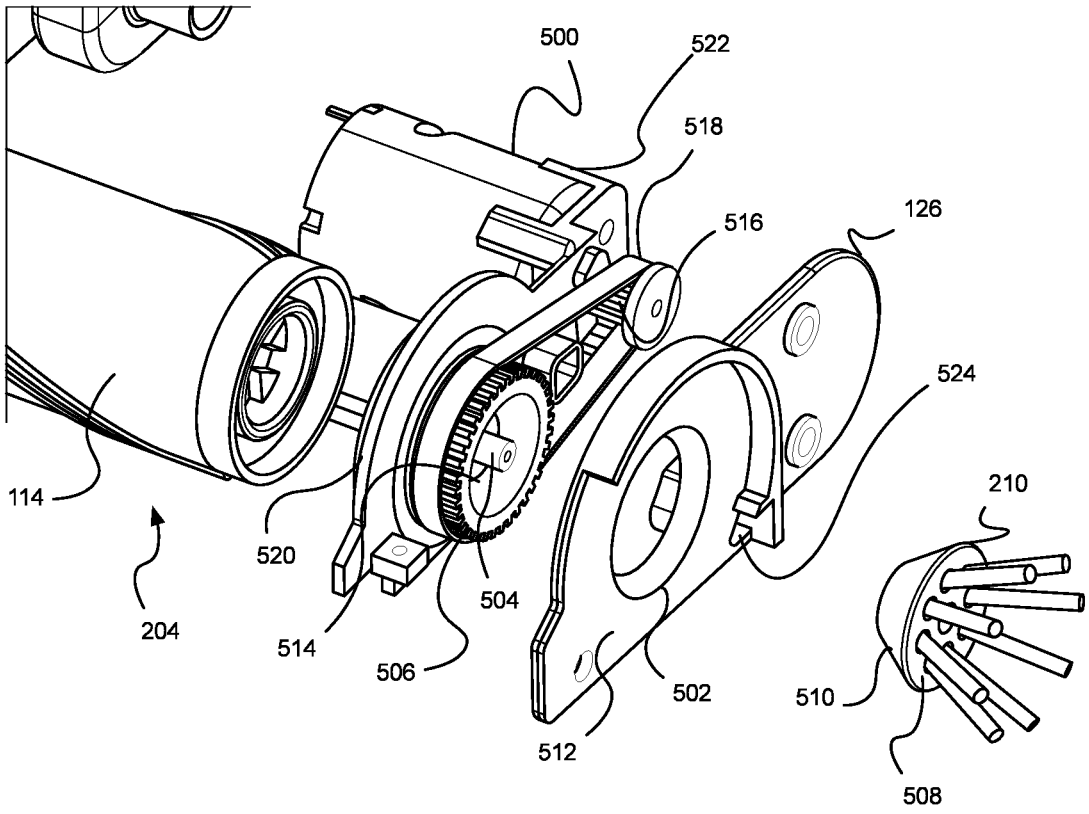
FIG. 5 shows an exploded perspective view of a cleaning accessory for a vacuum cleaner according to an example.

In some other examples, the first rotatable cleaning brush 140 and/or the second rotatable cleaning brush 210 are rotatably coupled to the rotatable cleaning bar 114 via a drive mechanism. For example, a belt or gears are rotatably coupled between the rotatable cleaning bar 114 and the first rotatable cleaning brush 140 and/or the second rotatable cleaning brush 210. FIG. 5 shows the second rotatable cleaning brush 210 is rotatably coupled to the rotatable cleaning bar 114 via a drive gear 506. The drive gear 506 will be discussed in more detail below in reference to FIG. 5.

This means that the axis of rotation A-A of the rotatable cleaning bar 114 can be remote from the axis of rotation of the first and/or second rotatable cleaning brush 140, 210. However, as shown in the Figures, the axis of rotation A-A of the rotatable cleaning bar 114 and the axis of rotation of the first and second rotatable cleaning brush 140, 210 are coaxial e.g. rotation axis A-A.

Figure 6:
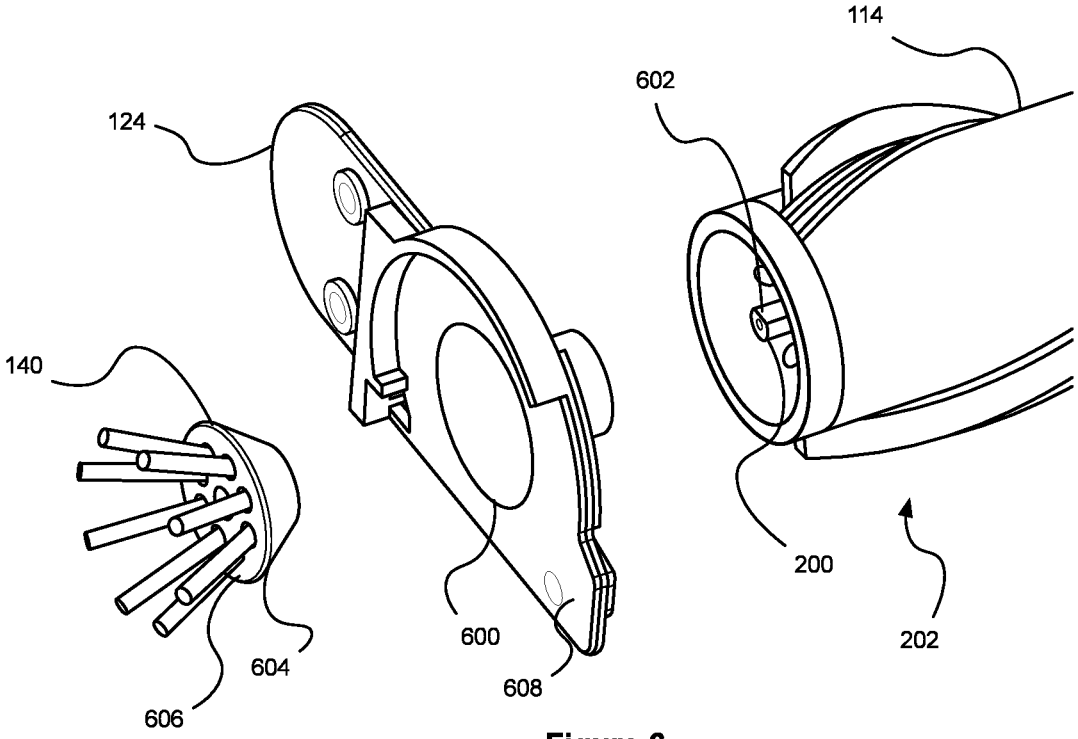
FIG. 6 shows another exploded perspective view of a cleaning accessory for a vacuum cleaner according to an example.
Figure 7:
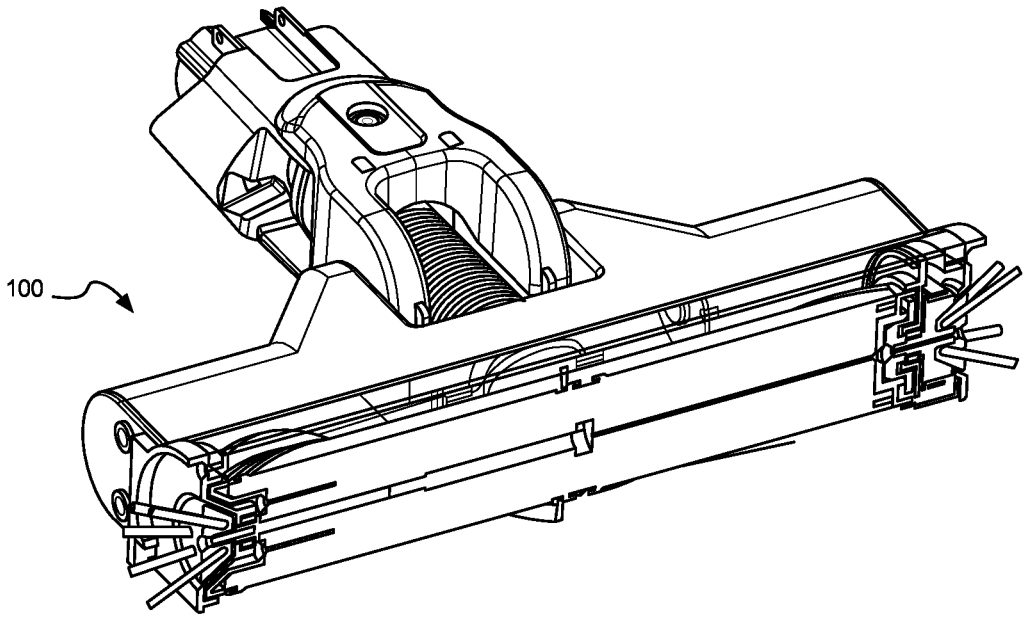
FIG. 7 shows a perspective cut away view of a cleaning accessory for a vacuum cleaner according to an example.
Figure 8A:
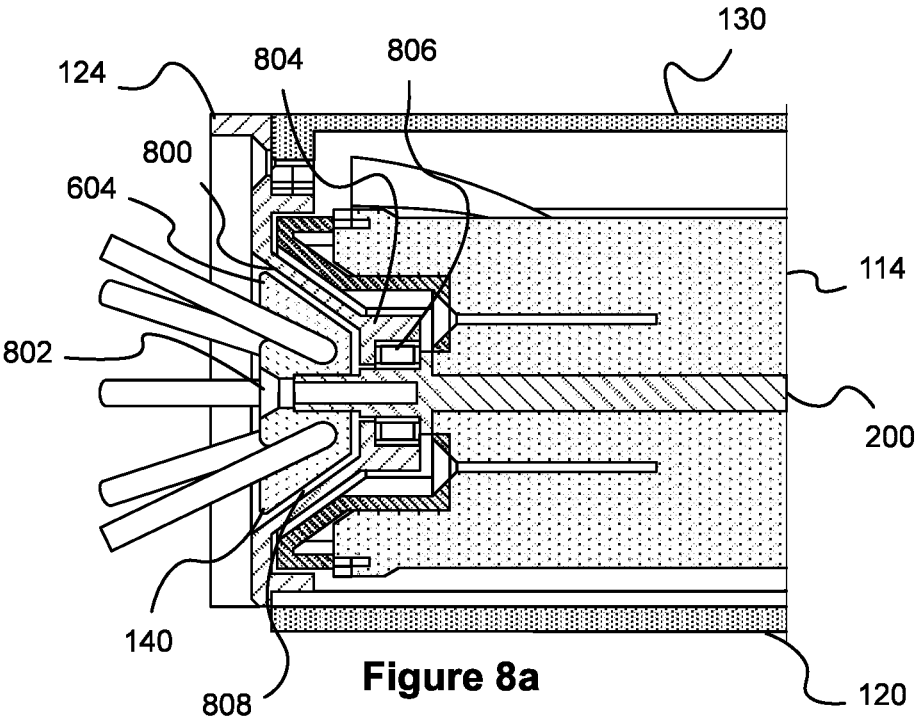
FIGS. 8*a* and 8*b* show close up cross-sectional views of a cleaning accessory for a vacuum cleaner according to an example.
Figure 8B:
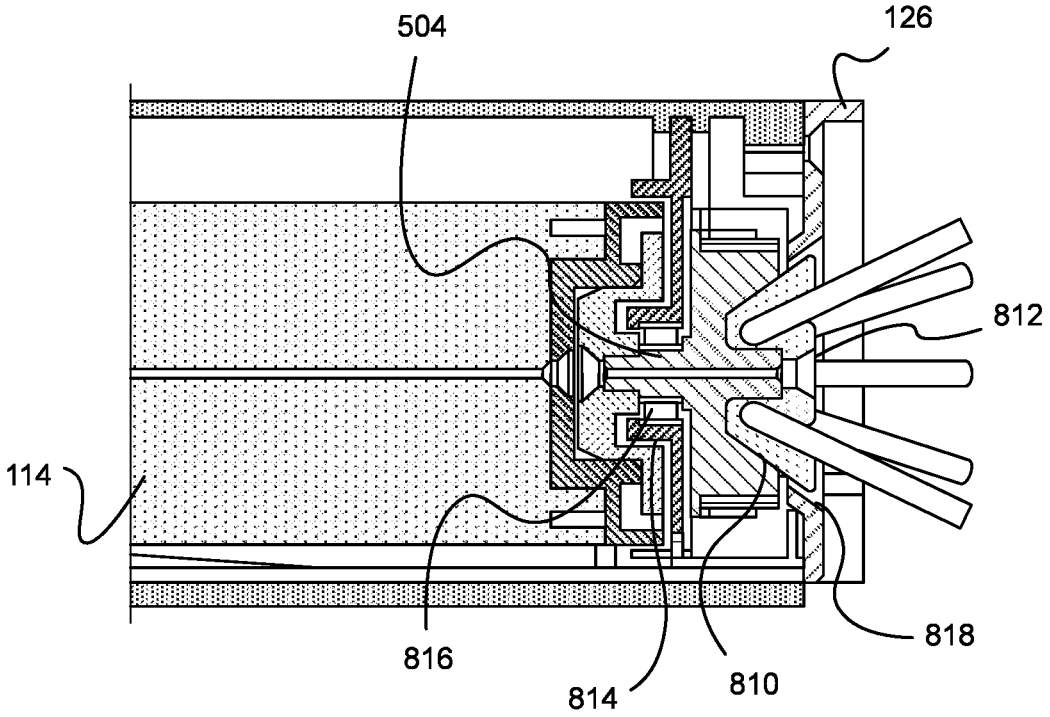

In some examples, the first and second rotatable cleaning brushes 140, 210 are optionally removably mountable on the rotatable cleaning bar 114. Turning to FIGS. 5, 6, 7, 8*a* and 8*b*, the construction of the cleaning accessory 100 will be discussed in further detail. FIG. 5 shows an exploded perspective view of the cleaning accessory 100 at the second end 204 of the rotatable cleaning bar 114. FIG. 6 shows another exploded perspective view of the cleaning accessory 100 at the first end 202 of the rotatable cleaning bar 114. FIGS. 8*a* and 8*b* respectively show close up cross-sectional views of the cleaning accessory 100. FIG. 8*a* is represented as dotted box labelled B in FIG. 2. FIG. 8*b* is represented as dotted box labelled C in FIG. 2. FIG. 7 shows a perspective cut away view of the cleaning accessory 100 with the parts shown in FIGS. 5 and 6 assembled.

Turning to FIG. 6, the first rotatable cleaning brush 140 will be discussed in further detail. FIG. 8*a* shows the parts shown in FIG. 6 in an assembled state. The first rotatable cleaning brush 140 projects through a hole 600 in the first side wall 124 of the housing 102. The first rotatable cleaning brush 140 slides on to the shaft 200. In some examples, the shaft 200 comprises a flat surface 602 or a keyed surface to prevent relative rotational movement of the first rotatable cleaning brush 140 with respect to the shaft 200 when the first rotatable cleaning brush 140 is mounted to the shaft 200. When the first rotatable cleaning brush 140 is mounted on the shaft 200, an outer surface 606 of the rotatable body 604 of the first rotatable cleaning brush 140 is flush with or recessed within a first side surface 608 of the first side wall 124 as shown in FIG. 1.

In some examples, the rotatable body 604 of the first rotatable cleaning brush 140 comprises a frustoconical shape arranged to be received in a reciprocal recess 808 with a first inclined reciprocal surface 800 in the first side wall 124. Advantageously, the frustoconical shape of the rotatable body 604 means that the rotatable body 604 seats correctly in the reciprocal recess 808.

In some examples the rotatable body 604 of the first rotatable cleaning brush 140 does not engage the first inclined reciprocal surface 800 in the first side wall 124. Accordingly the rotatable body 604 is held at a fixed distance from the first inclined reciprocal surface 800 in the first side wall 124. The first rotatable cleaning brush 140 is optionally fixed to the shaft 200 of the rotatable cleaning bar 114 with a first screw 802. As shown in FIG. 8*a*, optionally the shaft 200 projects through the first side wall 124 into the reciprocal recess 808. This means that the shaft 200 is visibly presented to the user within the reciprocal recess 808 and the first rotatable cleaning brush 140 is easier to mount on the shaft 200.

In this way, the first rotatable cleaning brush 140 is removeable from the rotatable cleaning bar 114 by removal of the first screw 802. The first rotatable cleaning brush 140 in some other examples can be mounted to the rotatable cleaning bar 114 with a toolless connection. For example, the first rotatable cleaning brush 140 can be mounted via a bayonet fitting, clips, or any other suitable mechanism.

The first side wall 124 comprises a bearing housing 804 and a bearing 806 is mounted in the bearing housing 804. The shaft 200 is threaded through and engages with the bearing 806 such that the shaft 200, the rotatable cleaning bar 114 and the first rotatable cleaning brush 140 rotate freely with respect to the first side wall 124.

The first side wall 124 as shown in FIG. 6 is mountable to the housing 102 via screws (not shown) or any other suitable fastening device.

Optionally in some examples, the second rotatable cleaning brush 210 is mountable to the shaft 200 and the rotatable cleaning bar 114 in the same way as discussed with respect to the first rotatable cleaning brush 140.

However, in some alternative examples, the first or the second rotatable cleaning brush 140, 210 is mountable on a drive gear 506 instead of mountable on a shaft 200 or within the rotatable cleaning bar 114 as shown in FIGS. 8*a*, 6. The examples as shown in FIGS. 5, 8*b* show the second rotatable cleaning brush 210 mountable on the drive gear 506.

Turning to FIG. 5, the second rotatable cleaning brush 210 will be discussed in further detail. FIG. 8*b* shows the parts shown in FIG. 5 in an assembled state.

The second rotatable cleaning brush 210 projects through a hole 502 in the second side wall 126 of the housing 102. The second rotatable cleaning brush 210 slides on to the drive shaft 504 connected to the drive gear 506. In some examples, the drive shaft 504 comprises a flat surface or a keyed surface to prevent relative rotational movement of the second rotatable cleaning brush 210 with respect to the drive shaft 504 when the second rotatable cleaning brush 210 is mounted to the drive shaft 504. As shown in FIG. 8*b*, the drive shaft 504 is integral with the drive gear 506. When the second rotatable cleaning brush 210 is mounted on the drive shaft 504, an outer surface 508 of a rotatable body 510 of the second rotatable cleaning brush 210 is flush with or recessed within a second side surface 512 of the second side wall 126 as shown in FIG. 8*b*.

In some examples, the rotatable body 510 of the second rotatable cleaning brush 210 comprises a frustoconical shape arranged to be received in a reciprocal recess 514 with an inclined reciprocal drive surface 810 in the drive gear 506. In addition, optionally, the hole 502 in the second side wall 126 comprises a second inclined reciprocal surface 818 reciprocal to the frustoconical shape of the rotatable body 510 of the second rotatable cleaning brush 210.

In some examples the rotatable body 510 of the second rotatable cleaning brush 210 does not engage the second inclined reciprocal surface 818 in the second side wall 126. Accordingly the rotatable body 510 is held at a fixed distance from the second inclined reciprocal surface 818 in the second side wall 126.

In some examples the rotatable body 510 of the second rotatable cleaning brush 210 engages with the inclined reciprocal drive surface 810 in drive gear 506. This means that the drive gear 506 rotates at the same rate of rotation as the second rotatable cleaning brush 210.

The second rotatable cleaning brush 210 is optionally fixed to the drive shaft 504 of the drive gear 506 with a second screw 812. In this way, the second rotatable cleaning brush 210 is removeable from the rotatable cleaning bar 114 and the drive gear 506 by removal of the second screw 812. The second rotatable cleaning brush 210 in some other examples can be mounted to the drive gear 506 with a toolless connection. For example, the second rotatable cleaning brush 210 can be mounted via a bayonet fitting, clips, or any other suitable mechanism.

As shown in FIG. 5, the motor 500 is mounted to the housing 102 via a motor mounting plate 520. The motor mounting plate 520 comprises fingers 522 for gripping the motor 500 and holding the motor 500 with respect to the housing 102. The motor mounting plate 520 is fixed with respect to the housing 102 by e.g. screws (not shown) or any other suitable fastening means. In some examples, the second side wall 126 is optionally fastened to the motor mounting plate 520. The motor mounting plate 520 extends in a direction parallel to the second side wall 126 and comprises a bearing housing 814 and a bearing 816 is mounted in the bearing housing 814 (best shown in FIG. 8*b*). The drive shaft 504 is threaded through and engages with the bearing 816 such that the drive shaft 504, the rotatable cleaning bar 114 and the second rotatable cleaning brush 210 rotate freely with respect to the second side wall 126.

The drive gear 506 is operatively connected to a motor gear 516. The motor gear 516 is mounted to a motor shaft (not shown). As shown in FIG. 5, the drive gear 506 and the motor gear 516 are connected via a belt 518. In some other examples the belt 518 is replaced with a gearbox (not shown) for transmitting rotation from the motor shaft to the drive gear 506.

In some further examples, there is optionally one or more gears operatively connected between the rotatable cleaning bar 114 and the first or second rotatable cleaning brush 140, 210. This means that the rotatable cleaning bar 114 and the first or second rotatable cleaning brush 140, 210 can rotate with respect to each other at different rates of rotation. For example, the rotatable cleaning bar 114 can rotate faster than the first or second rotatable cleaning brush 140, 210.

The second side wall 126 as shown in FIG. 5 is mountable to the housing 102 via screws (not shown) or any other suitable fastening device.

Another feature of the cleaning accessory 100 will now be discussed in reference to FIGS. 3*a*, 3*b*, 4*a*, 4*b* and 9.

In some examples the first side wall 124 optionally comprises a first side air inlet 300. The first side air inlet 300 is not necessary when the cleaning accessory 100 comprises a first or second rotatable cleaning brush 140, 210. This is because the dirt and debris dislodged by the first or second rotatable cleaning brush 140, 210 can be sucked into the air outlet 110 into the first air inlet 112 underneath the cleaning accessory 100. It is preferable to provide a first side air inlet 300 with a first rotating brush 140 because the dirt is more reliably picked up by the cleaning accessory 100.

In some other examples additionally or alternatively the second side wall 126 comprises a second side air inlet 524. In the examples below the first side air inlet 300 may only be discussed, but reference to the first side air inlet 300 can refer to alternatively or additionally to the second side air inlet 524.

As shown in FIG. 9, the first side air inlet 300 and the second side air inlet 524 respectively provide second airflow paths $p_1$, $p_2$ between the first side air inlet 300 and the second side air inlet 524 and the air outlet 110. Accordingly dirty air flows in from the first side air inlet 300 and/or the second side air inlet 524 to the air outlet 110. The second air flow paths $p_1$, $p_2$ in some examples bypass the rotatable cleaning bar 114. In some other examples, at least part of the first airflow path and the second airflow paths $p_1$, $p_2$ are located around the rotatable cleaning bar 114. In some examples, the second air flow paths $p_1$, $p_2$ overlap a portion of the first airflow path. This means that the internal structure of the cleaning accessory 100 can be made more compact.

As mentioned above, the cleaning accessory 100 comprises the first rotatable cleaning brush 140. In some examples, the at least one flexible cleaning element 142 is arranged to engage the surface 400 to be cleaned adjacent to the first or second side air inlet 300, 524. In some examples, the at least one flexible cleaning element 142 is arranged to guide dirt towards the first side air inlet 300. As shown in FIG. 3, the first rotatable cleaning brush 140 rotates in a clockwise direction as represented by the curved arrows in FIGS. 3*a* and 3*b*. This means that flexible cleaning elements 142 sweep the surface 400 to be cleaned and guide the dirt towards the first side air inlet 300 as represented by the straight arrow in FIG. 3*b*. As the dirt and debris is moved towards the first side air inlet 300 by the flexible cleaning elements 142, the dirt and debris becomes entrained in the airflow. The dirt and debris is then sucked into the cleaning accessory 100.

Whilst FIGS. 3*a* and 3*b* show the first rotatable cleaning brush 140 is rotatable as indicated by the arrow in a clockwise direction, in other alternative examples, the first cleaning brush 140 is optionally fixed to the first side wall 124. In this way, the first cleaning brush 140 is static and does not rotate with respect to the first side wall 124. Additionally or alternatively, the second cleaning bush 210 can also be fixed and not rotate with respect to the second side wall 126.

In the example where the first rotatable cleaning brush 140 is fixed with respect to the housing 102, the first cleaning brush 140 engages the surface 400 to be cleaned adjacent to the first side air inlet 300. The first cleaning brush 140 may also guide the dirt and debris on the surface 400 to be cleaned due to the shape and orientation of the flexible cleaning elements 142. For example, the flexible cleaning elements 142 of the first cleaning brush 140 are arranged in wedge shape with the apex of the wedge adjacent to the first side air inlet 300. The wedge shaped first cleaning brush 140 then funnels the dirt and debris into the first side air inlet 300 when the cleaning accessory 100 is moved in the forward direction X.

As shown in FIGS. 3*a* and 3*b*, the first side wall 124 comprises a projecting lip 302 arranged to guide dirt into the first side air inlet 300. The projecting lip 302 projects outwardly from the first side wall 124 and extends into the path of dirt swept by the first cleaning brush 140. In some examples, the projecting lip 302 is aligned with the first side air inlet 300. Accordingly, when dirt abuts the projecting lip 302, the dirt will be entrained into the airflow and enter the cleaning accessory 100 at the first side air inlet 300.

The first side wall 124 also comprises an optional dirt deflector 304. Similar to the projecting lip 302, the dirt deflector 304 projects out from the first side wall 124. The dirt deflector 304 is configured to surround at least a part of the perimeter of the first rotatable cleaning brush 140. The dirt deflector 304 is arranged to prevent the dirt is not swept backwards or upwards past the cleaning accessory 100. Instead, the dirt deflector 304 comprises a leading edge portion 306 which is directed downwards towards the surface 400 to be cleaned and in the direction X of forward travel. This means that if any dirt or debris is swept past the first side air inlet 300 by the rotating first rotatable cleaning brush 140, the dirt and debris will be flicked from the first rotatable cleaning brush 140 and releases in a direction T. The direction T is approximately a tangent to the curve of the leading edge portion 306 of the dirt deflector 304.

In some examples, the dirt deflector 304 optionally extends along the perimeter of the first rotatable cleaning brush 140 between 25% to 50% of the length of the perimeter of the first rotatable cleaning brush 140.

In some examples, optionally the dirt deflector 304 comprises a projecting finger 308. The projecting finger 308 is configured to engage the at least one flexible cleaning element 142 when the at least one flexible cleaning element 142 is rotating in the cleaning position as shown in FIG. 3*b*. The projecting finger 308 is configured to engage the at least one flexible cleaning element 142 after the at least one flexible cleaning element 142 has moved past the first side air inlet 300. This means that dirt lodged in the flexible cleaning elements 142 is scraped off when the flexible cleaning elements 142 move past the projecting finger 308. Since the projecting finger 308 causes the flexible cleaning elements 142 to flex during part of the rotation of the first rotatable cleaning brush 140, the dirt can be further encouraged to be flicked off the flexible cleaning elements 142 as the returns to shape.

Figure 4A:
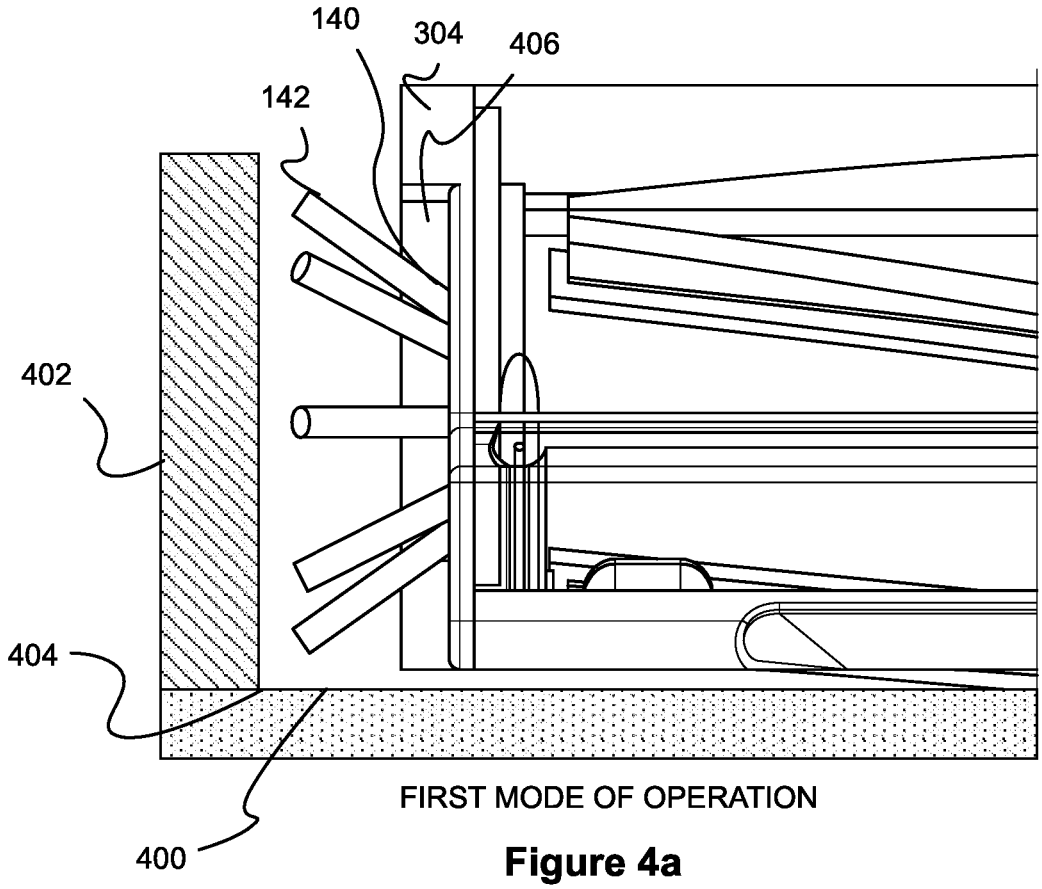
FIGS. 4*a* and 4*b* show a cross-sectional side view along A-A of a cleaning accessory for a vacuum cleaner respectively in different modes of operation according to an example.
Figure 4B:
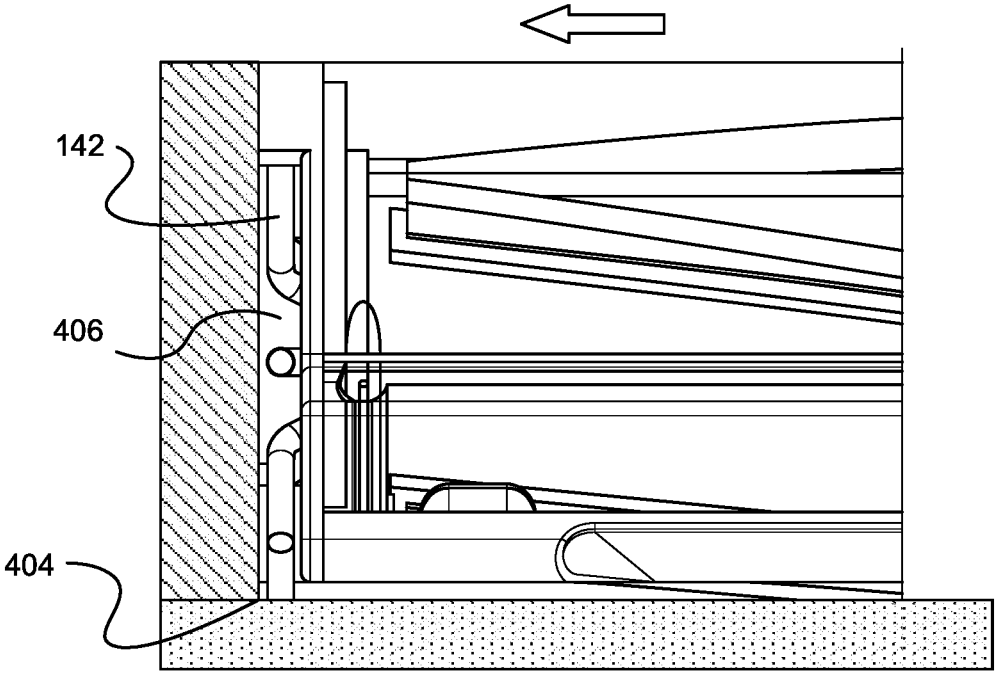

The projecting dirt deflector 304 and the projecting lip 302 define a brush recess 406 (best shown in FIGS. 4*a*, 4*b*). The projecting dirt deflector 304 and the projecting lip 302 are arranged to engage the upright surface 402. In some examples, the projecting dirt deflector 304 and the projecting lip 302 are arranged to engage the upright surface 402 and create a partial seal against the upright surface 402.

This means that the brush recess 406 adjacent to the upright surface 402 encourages the second airflow paths $p_1$, $p_2$ to be positioned around the first rotatable cleaning brush 140. This further reduces the dirt to be flicked out form the brush recess 406 and most of the dirt swept by the first rotatable cleaning brush 140 is entrained in to the air flow.

When the cleaning accessory 100 is pushed against the upright surface 402, the brush recess 406 is closed off from the first air inlet 112 and the dirt collected by the first rotatable cleaning brush 140 is sucked in via the first side air inlet 300.

The brush recess 406 is configured to receive the at least one flexible cleaning element 142 when the first side wall 124 is adjacent to the upright surface 402 and the at least one flexible cleaning element 142 flexes into the cleaning position. Accordingly, the brush recess 406 is configured to receive the first rotatable cleaning brush 140 and the flexible cleaning elements 142 when the first rotatable cleaning brush 140 is in the second mode of operation e.g., the cleaning position.

As can be seen from FIG. 4*b*, the brush recess 406 allows the first rotatable cleaning brush 140 to freely rotate without interference from the housing 102 and clean the upright surface 402 and the edge 404. In some examples, the biasing force of the flexible cleaning elements 142 means that the flexible cleaning elements 142 will be urged against the upright surface 402 and the edge 404. This means that a lower part of the upright surface 402 will also be cleaned by the first rotatable cleaning brush 140 during operation.

In another example, two or more examples are combined. Features of one example can be combined with features of other examples.

Examples of the present disclosure have been discussed with particular reference to the examples illustrated. However it will be appreciated that variations and modifications may be made to the examples described within the scope of the disclosure.

What is claimed is:

1. A cleaning accessory for a vacuum cleaner comprising: a housing; at least one rotatable cleaning brush rotatably mounted to the housing and configured to engage a surface to be cleaned, the cleaning brush having a rotation axis; wherein the at least one rotatable cleaning brush comprises at least one flexible cleaning element projecting outwards from a side of the housing; and wherein in operation the cleaning brush contacts a floor and the at least one flexible cleaning element is arranged to rotate in a cleaning position whereby the at least one flexible cleaning element contacts the floor; and wherein during the operation, the at least one flexible cleaning element rotates in a disengaged position whereby the at least one flexible cleaning element does not contact the floor.

2. The cleaning accessory according to claim 1 wherein the at least one flexible cleaning element is biased to the disengaged position.

3. The cleaning accessory according to claim 2 wherein the at least one flexible cleaning element is arranged to move vertically from the disengaged position to the cleaning position when a force is applied to the at least one flexible cleaning element in a direction parallel to the rotation axis of the rotatable cleaning brush.

4. The cleaning accessory according to claim 3 wherein the at least one flexible cleaning element extends vertically from the disengaged position to the cleaning position when the side of the housing is adjacent to an upright wall.

5. The cleaning accessory according to claim 1 wherein the cleaning accessory comprises a rotatable cleaning bar rotatably mounted within the housing and the at least one rotatable cleaning brush is rotatably coupled to the rotatable cleaning bar.

6. The cleaning accessory according to claim 5 wherein the rotatable cleaning bar comprises a first end arranged at the side of the housing and one of the at least one rotatable cleaning brush is mounted to the first end.

7. The cleaning accessory according to claim 6 wherein the at least one rotatable cleaning brush comprises a rotatable body and at least part of the rotatable body is arranged to project through the side of the housing to mount to the first end of the rotatable cleaning bar.

8. The cleaning accessory according to claim 6 wherein the rotatable cleaning bar comprises a second end and a second rotatable cleaning brush is mounted to the second end.

9. The cleaning accessory according to claim 5 wherein the at least one rotatable cleaning brush is removably mountable on the rotatable cleaning bar.

10. The cleaning accessory according to claim 5 wherein a drive mechanism is rotatably coupled between the at least one rotatable cleaning brush and the rotatable cleaning bar.

11. The cleaning accessory according to claim 5 wherein the at least one rotatable cleaning brush and the rotatable cleaning bar are arranged to rotate about the rotation axis of the cleaning brush.

12. The cleaning accessory according to claim 11 wherein the at least one flexible element when rotating in the cleaning position and the rotatable cleaning bar extend radially from the rotation axis a same distance.

13. The cleaning accessory according to claim 10 wherein the drive mechanism comprises a drive gear fixable to the at least one rotatable cleaning brush and the rotatable cleaning bar.

14. The cleaning accessory according to claim 10 wherein the drive mechanism is configured to rotate the at least one rotatable cleaning brush and the rotatable cleaning bar at a same rate of rotation.

15. The cleaning accessory according to claim 10 wherein the drive mechanism comprises a motor.

16. The cleaning accessory according to claim 15 wherein the motor is mounted to the housing adjacent to the rotatable cleaning bar.

17. The cleaning accessory according to claim 1 wherein the at least one flexible element does not project below a lower wall of the housing adjacent to the surface to be cleaned when rotating in the disengaged position.

* * * * *